US007678262B2

(12) United States Patent
Barthelet et al.

(10) Patent No.: US 7,678,262 B2
(45) **Date of Patent: *Mar. 16, 2010**

(54) HYDROCRACKING PROCESS WITH RECYCLE, COMPRISING ADSORPTION OF POLYAROMATIC COMPOUNDS FROM THE RECYCLED FRACTION ON AN ADSORBANT BASED ON SILICA-ALUMINA WITH A CONTROLLED MACROPORE CONTENT

(75) Inventors: Karin Barthelet, Lyons (FR); Patrick Euzen, Paris (FR); Hugues Dulot, Lyons (FR); Patrick Bourges, Lyons (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 386 days.

This patent is subject to a terminal disclaimer.

(21) Appl. No.: 11/370,174

(22) Filed: Mar. 8, 2006

(65) Prior Publication Data

US 2006/0213809 A1 Sep. 28, 2006

(30) Foreign Application Priority Data

Mar. 9, 2005 (FR) ..... 05 02368

(51) Int. Cl.
*C10G 47/02* (2006.01)

(52) U.S. Cl. ..... 208/108; 208/96; 208/98; 208/99; 208/58; 585/820

(58) Field of Classification Search ..... 208/108, 208/96, 98, 99, 58; 585/820
See application file for complete search history.

(56) References Cited

U.S. PATENT DOCUMENTS

| | | | | |
|---|---|---|---|---|
| 3,204,006 | A * | 8/1965 | Broughton | 208/89 |
| 4,447,315 | A | 5/1984 | Lamb et al. | |
| 4,954,242 | A * | 9/1990 | Gruia | 208/99 |
| 5,007,998 | A * | 4/1991 | Gruia | 208/59 |
| 5,464,526 | A * | 11/1995 | Saunders | 208/108 |
| 6,217,746 | B1 * | 4/2001 | Thakkar et al. | 208/59 |

* cited by examiner

*Primary Examiner*—Tam M Nguyen
(74) *Attorney, Agent, or Firm*—Millen, White, Zelano, Branigan, P.C.

(57) ABSTRACT

The invention concerns an improved hydrocracking process with a recycle having a step for eliminating polyaromatic compounds from at least a portion of the recycled fraction by adsorption on a particular adsorbent based on alumina-silica with a controlled macropore content.

20 Claims, 1 Drawing Sheet

Figure 1:
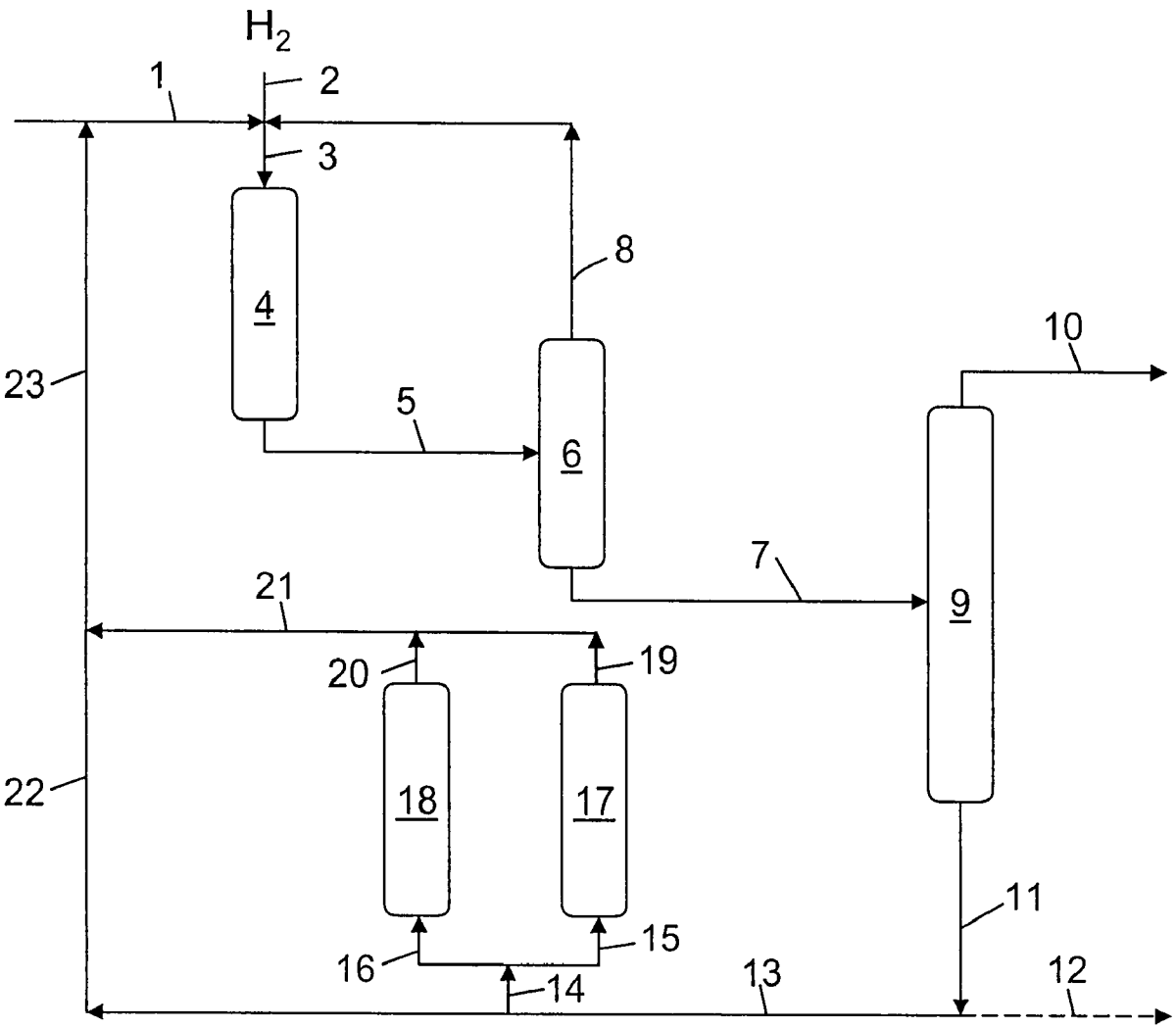

HYDROCRACKING PROCESS WITH RECYCLE, COMPRISING ADSORPTION OF POLYAROMATIC COMPOUNDS FROM THE RECYCLED FRACTION ON AN ADSORBANT BASED ON SILICA-ALUMINA WITH A CONTROLLED MACROPORE CONTENT

FIELD OF THE INVENTION

The invention concerns the elimination of polyaromatic compounds (PNA) in the field of hydrocracking processes.

DESCRIPTION OF THE PRIOR ART

A hydrocracking process is a process for converting heavy feeds (boiling point of higher hydrocarbons, in general 380° C.) from vacuum distillation. It functions at high temperature and under high hydrogen pressure and can produce very good quality products as they are rich in paraffinic and naphthenic compounds with very low impurity levels. However, that process suffers from a number of disadvantages: due to its hydrogen consumption, it is expensive and it does not have a very high yield (30% to 40% of the unconverted feed). It thus appears to be advantageous to use a recycle loop. However, that recycle results in an accumulation of polyaromatic compounds (PNA) which form during passage of the feed over the hydrocracking catalyst and eventually to the formation of coke on the same catalyst. This causes a loss of capacity, or even total deactivation of the catalyst (poisoning of adsorption sites and pore blockage). Further, the greater the size of those molecules, the lower their solubility: beyond a certain critical size, they precipitate and are deposited on the cold parts of the units such as the pipework and pumps, generating heat transfer problems in the exchangers and reducing their efficacy.

To overcome such problems, the simplest solution is to use a deconcentration purge on the recycle loop (U.S. Pat. No. 3,619,407, U.S. Pat. No. 4,961,839). The disadvantage of that technique is that it causes a reduction in the yield of the process by several conversion points. The technical problem posed is thus to develop an alternative technique which will ensure selective, total or partial elimination of PNAs from the recycled residue.

Polyaromatic molecules[1] (or PNA) are molecules constituted by an assembly of aromatic rings (one or more saturated rings may also be presented) which may or may not be substituted by alkyl groups. Because of their high molecular mass they are only slightly volatile and are often solid at ambient temperature. Finally, their high aromaticity and the absence of polar substituents on the rings results in very low solubility of such molecules in water or in alkanes. This solubility reduces further when the number and length of the alkyl side chains reduces.

[1] Julius Scherzer; A J Gruia, Hydrocracking Science and Technology; Marcel Dekker Inc; New York, 1996; Chapter 11, pp 200-214.

PNAs are sometimes classified into several categories depending on their number of rings: light PNAs have 2 to 6 rings; heavy PNAs containing 7 to 10 rings and finally, there are PNAs with more than 11 rings. It is generally known that the feeds at the inlet to the hydrocracking catalyst contain principally light PNAs. After passage over the hydrocracking catalyst, a higher concentration of said molecules is observed, but also the presence of heavy PNAs which are the molecules which are the most damaging to the hydrocracking process (deposition on the catalyst and in the unit/coke formation precursors). These latter may be formed either by condensation of two or more light PNAs, or by dehydrogenation of larger polycyclic compounds, or by cyclisation of pre-existing side chains on the PNAs, followed by dehydrogenation. Subsequently, combination reactions or dimerization reactions of heavy PNAs may take place, causing the formation of compounds containing more than 11 rings.

The formation of said heavy PNAs depends on the composition of the feed (the heavier it is, the more heavy PNA precursors it contains) but also the temperature of the reactor. The higher it is the more dehydrogenation and condensation will be encouraged, hence the greater formation of heavy PNAs. This temperature effect is more marked if the degree of conversion is high.

Several options are possible for the detection and analysis of PNAs.[2]. However, since mixtures of PNAs are frequently involved, it is preferable to initially separate the various molecules. To this end, liquid phase chromatography is used (HPLC). Next, detection, identification and assay of the PNAs may be carried out either by UV absorption or by fluorescence. These are specific methods for PNAs and they are thus sensitive, but they cannot always detect all PNAs (medium quantitative reliability). Direct analyses by mass spectrometry or IR can also be envisaged, but they are more difficult to implement and exploit.

[2] Milton L. Lee; Milos V Novotny; Keith D Bartie, Analytical Chemistry of Polycyclic Aromatic Compounds, Academic Press, Inc: London 1981.

Several methods for withdrawing PNAs from the recycled fraction have already been proposed in the literature: precipitation followed by filtration, hydrogenation and/or catalytic hydrocracking or adsorption on a porous solid.

PNA precipitation is caused by adding flocculent (U.S. Pat. No. 5,232,577) and/or reducing the temperature (U.S. Pat. No. 5,120,426) and is followed by decanting or centrifuging and phase separation. It is an effective technique, but it does not appear to be suitable for a continuously functioning hydrocracking process because of the high residence times necessary either for precipitation itself or for decantation of the PNAs and the probable crystallization of paraffins at the low temperatures applied.

Catalytic hydrogenation of PNAs (U.S. Pat. No. 4,411,768, U.S. Pat. No. 4,618,412, U.S. Pat. No. 5,007,998 and U.S. Pat. No. 5,139,644) can reduce the PNA content, but cannot completely eliminate it. Further, it necessitates fairly severe temperature and pressure conditions. Thus, while it is compatible with a continuously functioning hydrocracking process, it does not currently correspond to a very effective solution.

Adsorption is an effective method which, depending on the solid and the selected operation conditions, is compatible with a continuously functioning hydrocracker. In fact, this is the solution which is most frequently envisaged, as evidenced by the large number of patents which have been filed in this regard. They encompass several configurations of processes. The adsorption zone may be positioned either before or after the hydrocracker. In the first case, the feed is pre-treated (U.S. Pat. No. 4,775,460) and to eliminate the PNA precursors. However, given that the PNAs are principally formed during passage over the hydrocracking catalyst, the advantage of this solution is limited. In contrast, it is useful to seek to reduce or even to eliminate the PNAs from the fraction which will be recycled to the catalyst to prevent the molecules from enlarging and accumulating. Here again, several positions of the adsorption zone can be envisaged: at the outlet from a first SHP located before the distillation tower (U.S. Pat. No. 4,954,242, U.S. Pat. No. 5,139,646) or at the outlet from the distillation tower on a line in which all or only a portion of the recycled fraction passes (U.S. Pat. No. 4,447,315, U.S. Pat. No. 4,775,460, U.S. Pat. No. 5,124,023, U.S. Pat. No. 5,190, 633, U.S. Pat. No. 5,464,526, U.S. Pat. No. 6,217,746/WO02/074882). This second solution is the best. By positioning the adsorption zone after and not before the fractionation zone, the volume of feed to be treated is much smaller. In those patents, the adsorption zone and in particular the nature of the adsorbent is more or less detailed. In general, all of the conventional known adsorbents are cited: silica gel, activated charcoal, activated or non activated alumina, silica/alumina gel, clay, polystyrene gel, cellulose acetate, molecular sieve (zeolite). Of all of these solids, the most suitable appear to be activated charcoal, aluminas and amorphous silicas. Further, it is often mentioned that the solids selected must have a pore volume, a BET surface area and a pore diameter which are as high as possible. Some suggest the use of specifically prepared solids, such as a porous amorphous silica treated with sulphuric acid (U.S. Pat. No. 5,464,526) with the aim of improving their adsorption capacity as regards PNAs. Certain patents also exist which concern only the adsorbent. U.S. Pat. No. 3,340,316 proposes the use of activated charcoals impregnated with fluorinated compounds and EP-A1-0 274 432 concerns an inorganic material supporting a copper-based complex. The patents often describe the function of the adsorbent bed (fixed or moving bed, system with two beds in parallel) and the regeneration mode which may be envisaged for the adsorbent but without too many details. It principally concerns the displacement of PNAs adsorbed by the passage of a gaseous flow at high temperatures (method applicable both in- and ex-situ) or that of a liquid. In the first case, it is possible to use either an inert gas of lower efficacy, or an effective oxidizing gas (burning technique), but may cause degradation of the adsorbent in particular in the case of activated charcoal. It is also possible to envisage steam stripping, which allows operation at slightly lower temperatures (370-810° C.) than in the two preceding cases. U.S. Pat. No. 5,792,898 proposes the use of a hydrogen-rich gas at a temperature in the range 149° C. to 371° C. to at least partially desorb the aromatic compounds. The outlet effluent, once cooled to 16-49° C., is then sent to a liquid-vapour separator and the liquid is recovered in a distillation column to separate the mono compounds from the polyaromatic compounds. Regarding the liquid desorbant, it has to have a certain affinity with the solid to be capable of displacing the PNAs and with the PNAs to dissolve them. The best solvents are thus aromatic compounds alone (toluene, benzene, ethylbenzene, cumene, xylenes) or as a mixture (light cuts from the FCC reactor) (U.S. Pat. No. 5,124,023). Other types of solvents such as hydrocarbo-halogenated solvents, ketones, alcohols or light hydrocarbons alone or as a mixture (U.S. Pat. No. 4,732,665), have also been cited.

Adsorption appears to be the most suitable solution for eliminating PNAs in a hydrocracking unit, the optimum positioning of this purification zone being that at the outlet from the distillation tower. This is confirmed by the fact that only this solution has been implemented on an industrial scale[3]. It uses two 144 $m^3$ beds of activated charcoal, functioning in downflow mode, installed in series. When the first bed has to be treated (simple back flush, applicable only three times, or complete renewal of the adsorbent), the second bed functions alone. The disadvantage of that process is that it does not envisage regeneration of the activated charcoal and is thus expensive.

[3] Stuart Frazer; Warren Shirley PTQ 1999, 632, 25-35.

To render this process economically advantageous, a solid having good adsorption capacities for PNAs which is simultaneously regeneratable has to be found. While activated charcoals are solids having the highest adsorption capacities, they cannot currently be regenerated except by solvent elution. Apart from the fact that the quantity of solvent required is very large, a supplemental separation system must be used to recycle the solvent. This solution would thus be much too expensive to carry out. In the context of a refinery, the ideal solution would be to be able to regenerate the solids by burning. However, this technique is not applicable to activated charcoals. Thus, solids which perform well compared with activated charcoal but which are more resistant must be identified. The solids proposed until now as an alternative to activated charcoals would have relatively poor performances, probably due to the fact that the pore size is too low (molecular sieve) or the surface area is too low (amorphous meso and/or macroporous silica gel, activated alumina).

The solid adsorbent must be capable of selectively retaining a large quantity of the PNAs with a selectivity of more than 1, preferably between 2 and 5 for coronene with respect to other less heavy PNAs such as pyrene (4 aromatic rings) or perylene (5 aromatic rings). Further, to be able to use the porosity of the adsorbent in an optimal manner, it is necessary for it to have free openings (accommodating the Van der Waals radii of atoms aimed at the centre of the pore) with pores larger than 11.4 Å (calculations from the literature carried out by considering a planar molecule with bond lengths of 1.395 Å for C—C, 1.084 Å for C—H and 1.2 Å for the Van der Waals radius of the hydrogen atom[4] and preferably more than 20 Å. This condition excludes microporous solids such as zeolites since faujasite, which is the zeolite with the largest pores, has tunnels with 7.4 Å openings. In contrast, the pore openings do not have to be too wide, to prevent the specific surface area, the pore volume and thus the total adsorption capacity, from becoming too small. The specific surface area must generally be more than 200 $m^2/g$, preferably more than 400 $m^2/g$. This explains why silica gels and aluminas, which often have BET specific surface areas of less than 200 $m^2/g$, are not suitable for adsorption of PNAs. Finally, it is preferable to use a solid the pore network of which has branches to avoid the situation in which adsorption of molecules blocks the entrances to pores or tunnels which are still vacant. This is not the case either for mesotructured materials or for bridged clays. Because of these constraints, the solids which appear to be the most suitable for adsorption of PNAs with the exception of activated charcoals are amorphous mesoporous silica-aluminas. While they have pore volumes, specific surface areas and thus adsorption capacities which are lower than activated charcoals, they have the advantage of being prepared at high temperature and are thus resistant to burning.

[4] Henry W Haynes, Jr; Jon f Parcher; Norman E Heimer, Ind Eng Chem Process Des Dev, 1983, 22, 409.

DESCRIPTION OF THE INVENTION

The present invention proposes an improved hydrocracking process having a step for eliminating polyaromatic compounds from at least a portion of the recycled portion by adsorption on an adsorbent based on silica-alumina which has good adsorption capacities because of its high specific surface area and its pores with a sufficient size to be accessible to molecules containing more than 4 rings. This invention can thus effectively eliminate PNAs from the feed while offering the possibility of using the same adsorbent over several cycles because it can be regenerated by burning. Further, these solids have the advantage of being denser than activated charcoals, which partially compensates for their lower adsorption capacity at iso-adsorbent mass. In addition to the increase in consumption of solid, this can avoid supplemental investments such as using a distillation column, which is necessary in the case of solvent regeneration.

More precisely, the invention concerns an improved hydrocracking process with a recycle, having a step for eliminating polyaromatic compounds from at least a portion of the recycled portion by adsorption on an adsorbent based on alumina-silica (i.e. comprising alumina and silica) with a mass content of silica ($SiO_2$) of more than 5% by weight and 95% or less; said alumina-silica having:

- a sodium content of less than 0.03% by weight;
- a total pore volume, measured by mercury porosimetry, in the range 0.45 to 1.2 ml/g;
- a porosity such that:
  - i) the volume of mesopores with a diameter in the range 40 Å to 150 Å and a mean pore diameter in the range 80 Å to 140 Å (preferably in the range 80 Å to 120 Å) represents 30-80% of the total pore volume measured by mercury porosimetry;
  - ii) the volume of macropores with a diameter of more than 500 Å represents 20-80% of the total pore volume measured by mercury porosimetry;
- a BET specific surface area in the range 200 to 550 $m^2/g$;
- an X ray diffraction diagram which contains at least the principal characteristic peaks of at least one of the transition aluminas included in the group composed of alpha, rho, khi, eta, gamma, kappa, theta and delta aluminas.

The process generally comprises the following steps:

- a hydrocracking step (hydrocracking advantageously being carried out using the "once-through" mode or using the "two-step" mode described below);
- a separation step, generally in an atmospheric distillation tower, to separate (from the column bottom) an unconverted fraction with a T05 cut point of more than 340° C.; and
- a step for liquid phase adsorption of all or part of the PNAs contained in said unconverted fraction (heavy fraction from distillation).

Preferably, the adsorbent undergoes regeneration treatment by burning after the adsorption step.

The adsorption step may be carried out on all or only part of the recycled fraction and may function continuously or batchwise. Preferably, the adsorption step is carried out on the whole of the recycled fraction.

DETAILED DESCRIPTION OF THE INVENTION

Step 1: Hydrocracking

Feeds

A wide variety of feeds may be treated by the hydrocracking processes described below; generally, they contain at least 20% by volume and usually at least 80% by volume of compounds boiling above 340° C.

The feed may, for example, be LCO (light cycle oil—light gas oils derived from a catalytic cracking unit), atmospheric distillates, vacuum distillates, for example gas oils from straight run crude oil distillation or from conversion units such as FCC units, coker units or visbreaking units, as well as feeds from units for the aromatic extraction of lubricating base oils or from solvent dewaxing of lubricating base oils, or from distillates deriving from processes for desulphurization or hydroconversion in a fixed bed or ebullated bed of RAT (atmospheric residues) and/or RSV (vacuum residues) and/or deasphalted oils, or the feed may be a deasphalted oil or any mixture of the feeds cited above. The above list is not limiting. In general, the feeds have a boiling point T5 which is more than 340° C., and better still more than 370° C., i.e. 95% of the compounds present in the feed have a boiling point of more than 340° C., and better more than 370° C.

The nitrogen content in the feeds treated in the hydrocracking processes is usually more than 500 ppm, preferably in the range 500 to 1000 ppm by weight, more preferably in the range 700 to 4000 ppm by weight and still more preferably in the range 1000 to 4000 ppm. The sulphur content of the feeds treated in the hydrocracking processes is usually in the range 0.01% to 5% by weight, preferably in the range 0.2% to 4% and still more preferably in the range 0.5% to 2%.

The feed may optionally contain metals. The cumulative nickel and vanadium content of feeds treated in the hydrocracking processes is preferably less than 1 ppm by weight.

The asphaltenes content is generally less than 3000 ppm, preferably less than 1000 ppm, and more preferably less than 200 ppm.

Guard Beds

In the case in which the feed contains resins and/or asphaltene type compounds, it is advantageous to initially pass the feed over a bed of catalyst or adsorbant which differs from the hydrocracking or hydrotreatment catalyst.

The catalysts or guard beds used have the shape of spheres or extrudates. Advantageously, however, the catalyst is in the form of extrudates with a diameter in the range 0.5 to 5 mm and more particularly in the range 0.7 to 2.5 mm. The shapes are cylindrical (hollow or otherwise), twisted cylinders, multilobes (2, 3, 4 or 5 lobes, for example), rings. The cylindrical shape is preferred, but any other form may be used.

To remedy the presence of contaminants and/or poisons in the feed, the guard catalysts may, in a further preferred implementation, have more particular geometric shapes to increase their void fraction. The void fraction of these catalysts is in the range 0.2 to 0.75. Their external diameter may be between 1 and 35 mm. Non-limiting particular possible shapes are: hollow cylinders, hollow rings, Raschig rings, hollow toothed cylinders, hollow crenellated cylinders, penta-ring wheels, multi-holed cylinders, etc.

These catalysts may have been impregnated with an active or inactive phase. Preferably, the catalysts are impregnated with a hydrodehydrogenating phase. More preferably, the CoMo or NiMo phase is used.

These catalysts may have macroporosity. The guard beds may be those sold by Norton-Saint-Gobain, for example MacroTrap® guard beds. The guard beds may be those sold by Axens from the ACT family: ACT077, ACT935, ACT961 or HMC841, HMC845, HMC941 or HMC945.

It may be particularly advantageous to superimpose these catalysts in at least two different beds of varying heights. Catalysts with the highest void fraction are preferably used in the first catalytic bed(s) at the inlet to the catalytic reactor. It may also be advantageous to use at least two different reactors for these catalysts.

Preferred guard beds of the invention are HMC and ACT961.

Operating Conditions

The operating conditions, such as temperature, pressure, hydrogen recycle, hourly space velocity, may vary widely depending on the nature of the feed, the desired quality of the products and the facilities available at the refinery. The hydrocracking/hydroconversion catalyst or hydrotreatment catalyst is generally brought into contact in the presence of hydrogen with the feeds described above, at a temperature of more than 200° C., usually in the range 250° C. to 480° C., advantageously in the range 320° C. to 450° C., preferably in the range 330° C. to 435° C., at a pressure of more than 1 MPa, usually in the range 2 to 25 Pa, preferably in the range 3 to 20 MPa, the space velocity being in the range 0.1 to 20 $h^{-1}$, and preferably 0.1-6 $h^{-1}$, more preferably 0.2-3 $h^{-1}$, and the quantity of hydrogen introduced is such that the volume ratio of litres of hydrogen/litres of hydrocarbon is in the range 80 to 5000 l/l and usually in the range 100 to 2000 l/l.

These operating conditions used in the hydrocracking processes generally produce a conversion per pass into products having boiling points of less than 340° C., preferably less than 370° C., of more than 15%, preferably in the range 20% to 95%.

Implementations

The hydrocracking and/or hydroconversion processes using the catalysts of the invention cover pressure and conversion ranges from mild hydrocracking to high pressure hydrocracking. The term "mild hydrocracking" means hydrocracking resulting in moderate conversions, generally less than 40%, and operating at low pressure, generally in the range 2 MPa to 6 MPa.

The hydrocracking catalyst may be used alone in a single or a plurality of fixed catalytic beds, in one or more reactors, in a hydrocarbon layout termed a once-through process, with or without a liquid recycle of the unconverted fraction, optionally in association with a hydrorefining catalyst located upstream of the hydrocracking catalyst.

The hydrocracking catalyst may be used alone, in one or more ebullated bed reactors, in a once-through hydrocracking process, with or without a liquid recycle of the unconverted fraction, optionally in association with a hydrorefining catalyst located upstream of the hydrocracking catalyst in a fixed bed reactor or in an ebullated bed reactor.

The ebullated bed operates with withdrawal of the used catalyst and daily addition of fresh catalyst to keep the activity of the catalyst stable.

In a two-step hydrocracking process with intermediate separation between the two reaction zones, in a given step, the hydrocracking catalyst may be used in one or more reactors, in combination or otherwise with a hydrorefining catalyst located upstream of the hydrocracking catalyst.

Once-Through Process

Once-through hydrocracking generally comprises, firstly, deep hydrorefining aimed at deep hydrodenitrogenation and hydrodesulphurization of the feed before sending it to the hydrocracking catalyst proper, in particular when the latter comprises a zeolite. This deep hydrorefining of the feed produces only limited conversion of the feed into lighter fractions, which is insufficient and must thus be supplemented on the more active hydrocracking catalyst. However, it should be noted that no separation is carried out between the two types of catalyst. The whole of the effluent from the reactor is injected onto the hydrocracking catalyst proper and separation of the products formed is only carried out after this. This version of hydrocracking, once-through hydrocracking, has a variation which involves recycling the unconverted fraction to the reactor for deeper conversion of the feed.

Fixed Bed Once-Through Process

In the case in which the catalyst based on silica-alumina is used upstream of a zeolitic hydrocracking catalyst, for example based on Y zeolite, a catalyst having a high silica weight content is advantageously used, i.e. with weight contents of silica of the support forming part of the composition of the catalyst comprises 20% to 80%, preferably 30% to 60%. It may also advantageously be used in association with a hydrorefining catalyst, this latter being located upstream of the hydrocracking catalyst.

When the catalyst of the present invention is used upstream of a hydrocracking catalyst based on alumina-silica or zeolite, in the same reactor in distinct catalytic beds or in distinct reactors, conversion is generally (or preferably) less than 50% by weight and preferably less than 40%.

The hydrocracking catalyst may be used upstream or downstream of the zeolitic catalyst. Upstream of the zeolitic catalyst, it can crack PNAs.

Ebullated Bed Once-Through Process

The hydrocracking catalyst may be used alone in one or more reactors.

In the context of such a process, several reactors in series may advantageously be used, the ebullated bed reactor or reactors containing the hydrocracking catalyst being preceded by one or more reactors containing at least one hydrorefining catalyst in a fixed or ebullated bed.

When the catalyst based on silica-alumina is used downstream of a hydrorefining catalyst, conversion of the fraction of the feed occasioned by this hydrorefining catalyst is generally (or preferably) less than 30% by weight and preferably less than 25%.

Fixed Bed Once-Through Process With Intermediate Separation

The catalyst based on silica-alumina may also be used in a once-through hydrocracking process comprising a hydrorefining zone, a zone allowing partial elimination of ammonia, for example by a hot flash, and a zone comprising a hydrocracking catalyst. This once-through process for hydrocracking hydrocarbon feeds for the production of middle distillates and possibly oil bases comprises at least one first reaction zone including hydrorefining, and at least one second reaction zone, in which hydrocracking of at least a portion of the effluent from the first reaction zone is carried out. This process also comprises incomplete separation of ammonia from the effluent leaving the first zone. This separation is advantageously carried out using an intermediate hot flash. Hydrocracking in the second reaction zone is carried out in the presence of ammonia in a quantity which is smaller than the quantity present in the feed, preferably less than 1500 ppm by weight, more preferably less than 1000 ppm by weight and still more preferably less than 800 ppm by weight of nitrogen. The hydrocracking catalyst is preferably used in the hydrocracking reaction zone in combination or not with a hydrorefining catalyst located upstream of the hydrocracking catalyst. The hydrocracking catalyst may be used upstream or downstream of a zeolitic catalyst. Downstream of the zeolitic catalyst, PNAs or PNA precursors may be converted.

The hydrocracking catalyst may be used either in the first reaction zone for converting pretreatment, alone or in association with a conventional hydrorefining catalyst, located upstream of the catalyst of the invention, in one or more catalytic beds, in one or more reactors.

Once-Through Hydrocracking Process With Preliminary Hydrorefining On Low Acidity Catalyst The catalyst of the invention may be used in a hydrocracking process comprising:

- a first hydrorefining reaction zone in which the feed is brought into contact with at least one hydrorefining catalyst having, in a standard activity test, a degree of cyclohexane conversion of less than 10% by weight;
- a second hydrocracking reaction zone in which at least a portion of the effluent from the hydrorefining step is brought into contact with at least one zeolitic hydrocracking catalyst having, in the standard activity test, a degree of cyclohexane conversion of more than 10% by weight, the catalyst of the invention being present in at least one of the two reaction zones.

The proportion of the catalytic volume of the hydrorefining catalyst generally represents 20% to 45% of the total catalytic volume.

The effluent from the first reaction zone is at least partially, preferably entirely introduced into the second reaction zone of said process. Intermediate gas separation may be carried out as described above.

The effluent from the second reaction zone undergoes final separation (for example by atmospheric distillation, optionally followed by vacuum distillation), to separate the gases. At least one residual liquid fraction is obtained, essentially containing products with a boiling point of generally more than 340° C., which may be recycled at least in part upstream of the second reaction zone of the process of the invention, and preferably upstream of the hydrocracking catalyst based on alumina-silica, with the aim of producing middle distillates.

The conversion of products having boiling points of less than 340° C. or less than 370° C. is at least 50% by weight.

Two-Step Process

Two-step hydrocracking comprises a first step aimed, as in the once-through process, at hydrorefining the feed, but also at producing a conversion thereof which is generally of the order of 40% to 60%. The effluent from the first step then undergoes separation (distillation) which is usually termed intermediate separation, which is aimed at separating the conversion products from the unconverted fraction. In the second step of a two-step hydrocracking process, only the fraction of feed that is not converted in the first step is treated. This separation allows a two-step hydrocracking process to be more selective in middle distillate (kerosene+diesel) than a once-through process. In fact, intermediate separation of the conversion products avoids "overcracking" them into naphtha and gas in the second step on the hydrocracking catalyst. Further, it should be noted that the unconverted fraction of the feed treated in the second step generally contains very small amounts of $NH_3$ as well as organic nitrogen-containing compounds, in general less than 20 ppm by weight or even less than 10 ppm by weight.

The same configuration of fixed bed or ebullated bed catalytic beds may be used in the first step of a two-step process as when the catalyst is used alone or in association with a conventional hydrorefining catalyst. The hydrocracking catalyst may be used upstream or downstream of a zeolitic catalyst. Downstream of the zeolitic catalyst, it can convert PNAs or PNA precursors.

For once-through processes and for the first step of two-step hydrocracking processes, preferred catalysts of the invention are doped catalysts based on non noble group VIII elements, more preferably catalysts based on nickel and tungsten, the preferred doping element being phosphorus.

The catalysts used in the second step of the two-step hydrocracking process are preferably doped catalysts based on elements from group VIII, more preferably catalysts based on platinum and/or palladium, the preferred doping element being phosphorus.

Step 2: Separation of Different Cuts in a Distillation Tower

This step consists of separating the effluent from the hydrocracking reactor into different oil cuts. After separation of the liquid and gaseous streams using high and medium pressure separators, the liquid effluent is injected into an atmospheric distillation column to separate and stabilize the cuts in accordance with the desired distillation intervals.

The unconverted fraction which is to be treated in the present invention is then obtained from the bottom of the atmospheric distillation column, more specifically by withdrawal from the reboiler, and in accordance with the present invention corresponds to a fraction with a cut point T05 of more than 340° C.

Because of their normal boiling temperature, well over 340° C., the polyaromatic compounds which the present invention proposes to eliminate are all concentrated in this heavy fraction from the bottom of the distillation tower (heavy residue).

In the case of a once-through hydrocracking process and a step with intermediate separation, the unconverted portion (having a boiling point of more than 340° C.) is generally at least partially recycled and re-injected either to the inlet to the hydrorefining catalyst, or to the inlet for the hydrocracking catalyst (preferable).

In the case of a two-step hydrocracking process, the unconverted portion (with a boiling point of more than 340° C.) is generally at least partially recycled and re-injected into the second hydrocracking reaction zone.

Step 3: Adsorption of PNAs Contained in the Heavy Residue by Passing all or Part Thereof into the Adsorption Zone This step consists of eliminating all or a part of the polyaromatic compounds contained in all or part of the recycled fraction derived from the bottom of the distillation tower column (380+ fraction or heavy residue), i.e. from step 2. The aim is to keep the polyaromatic compound content below a certain critical concentration beyond which deactivation of the hydrocracking catalyst would be observed (deactivation due to an accumulation of PNAs in the porous framework of the hydrocracking catalyst and which can cause poisoning of the active sites and/or blockage or access to these same sites) and deposition on the cold portions of the process. Thus, the concentration of PNA is controlled in the fraction recycled to the hydrocracking catalyst. Depending on the case, it is thus possible to limit the feed volumes to be treated and thus to minimize the cost of the overall process. Since preliminary studies have shown that the molecules which do the most damage to the hydrocracking catalyst are compounds having a minimum of 7 fused rings (from coronene), in principal the concentration of coronene should be monitored; this cannot exceed that of the fraction recycled to processes where a purge is carried out, i.e. 40 ppm. This concentration limits deactivation of the catalyst to 2° C./month.

At least a portion of the unconverted feed from the hydrocracker is brought into contact with a solid adsorbent which is generally capable of selectively retaining a large quantity of PNAs with a selectivity of more than 1 and preferably 2 to 5 for coronene compared with other lighter PNAs such as pyrene (4 aromatic rings) or perylene (5 aromatic rings).

Characteristics of Solid Adsorbent Which Can be Used in the Process of the Invention The adsorbent is based on alumina-silica, said alumina-silica having the following characteristics:

- a percentage of silica in the range 5% to 95% by weight, preferably in the range 10% to 80%, more preferably in the range 20% to 60% and still more preferably in the range 30% to 50%;

a sodium content of less than 0.03% by weight;

a total pore volume, measured by mercury porosimetry, in the range 0.45 to 1.2 ml/g;

a porosity such that:

i) the volume of mesopores with a diameter in the range 40 Å to 150 Å and a mean pore diameter in the range 80 Å to 140 Å (preferably in the range 80 Å to 120 Å) represents 30-80% of the total pore volume, preferably 40% to 70%;

ii) the volume of macropores with a diameter of more than 500 Å, preferably 1000 Å to 10000 Å, represents 20% to 80% of the total pore volume, preferably 30% to 60% of the total pore volume and more pr the volume of macropores represents at least 35% of the total pore volume;

a BET specific surface area in the range 200 to 550 $m^2/g$, preferably in the range 200 to 500 $m^2/g$, more preferably less than 350 $m^2/g$ and still more preferably in the range 200 to 350 $m^2/g$;

an X ray diffraction diagram which contains at least the principal characteristic peaks of at least one of the transition aluminas included in the group composed of rho, khi, kappa, eta, gamma, theta and delta aluminas, preferably containing at least the principal characteristic peaks of at least one transition alumina included in the group composed of gamma, eta, theta an delta alumina, more preferably which contains at least the principal characteristic peaks of gamma and eta alumina, and still more preferably which contains peaks with a "d" in the range 1.39 to 1.40 Å to a "d" in the range 1.97 Å to 2.00 Å.

Preferably, the alumina-silica comprises 30% to 50% of $Q^2$ sites, in which one atom of Si is bonded to two atoms of Si or Al and to two OH groups and also comprises 10-30% of $Q^3$ sites in which one atom of Si is bonded to three atoms of Si or Al or to one OH group.

The adsorbent which can be used in the process of the invention also comprises:

preferably, a cationic impurities content of less than 0.1% by weight, more preferably less than 0.05% by weight and still more preferably less than 0.025% by weight. The term "cationic impurities content" means the total alkali content;

preferably, an anionic impurities content of less than 1% by weight, more preferably less than 0.5% by weight and still more preferably less than 0.1% by weight;

optionally, at least one hydrodehydrogenating element selected from the group formed by elements from group VIB and group VIII of the periodic table, preferably with a weight content of group VIB metal(s), in the metallic form or in the oxide form, in the range 1% to 50% by weight, preferably in the range 1.5% to 35% by weight, more preferably in the range 1.5% to 30% by weight, and preferably a weight content of group VIII metals in the metallic form or in the oxide form in the range 0.1% to 30% by weight, preferably 0.2% to 25% and more preferably in the range 0.2% to 20% by weight;

optionally, 0.01% to 6% of phosphorus as the doping element deposited on the catalyst (the term "doping element" means an element introduced after preparation of the alumino-silicate adsorbent described above), optionally in combination with boron and/or silicon. Thus, a combination of phosphorus and boron or a phosphorus, boron and silicon combination may be used as doping elements. When the elements boron and/or silicon are present on the catalyst, the boron and silicon contents, calculated in their oxide form, are in the range 0.01% to 6% by weight, preferably in the range 0.1% to 4% by weight, more preferably in the range 0.2% to 2.5%;

optionally, at least one group VIIB element (preferably manganese for example), and a content in the range 0 to 20% by weight, preferably in the range 0 to 10% by weight of the compound in the oxide or metallic form;

optionally, at least one group VB element (preferably niobium for example), and a content in the range 0 to 40% by weight, preferably in the range 0 to 20% by weight of the compound in the oxide or metallic form;

In a preferred implementation of the invention, the catalyst support is constituted by alumina-silica alone.

In a further implementation of the invention, the support comprises 1% to 40% by weight of binder. The support may then result from a mixture of alumina-silica and at least one binder selected from the group formed by silica, alumina, clays, titanium oxide, boron oxide and zirconia.

In the adsorbent, the proportion of octahedral $Al_{VI}$, determined by solid $^{27}Al$ MAS NMR, is generally more than 50%.

The adsorbent may also contain a minor proportion of at least one promoter element selected from the group formed by zirconia and titanium.

Preferably, the adsorbent undergoes hydrothermal treatment after synthesis, as described below.

Preferably, before use, the adsorbent undergoes a sulphurization step, using any technique known to the skilled person.

The adsorbent of the invention may contain a zeolite (preferably it contains no zeolite). The total weight content of zeolite in the adsorbent is generally in the range 0% to 30%, advantageously in the range 0.2% to 25%, preferably in the range 0.3% to 20%, highly preferably in the range 0.5% to 20% and still more preferably in the range 1% to 10%.

Depending on the amount of zeolite introduced, the X ray diffraction diagram of the adsorbent also in a general manner contains the principal peaks which are characteristic of the selected zeolite or zeolites.

The techniques for characterization and the characteristics of the silica-alumina base of the adsorbent used in the PNA elimination process of the invention are described in the French patent application entitled "Catalyseur alumino-silicate dopé et procédé amélioréde traitement de charges hydrocarbonées" ["Doped alumino-silicate catalyst and improved hydrocarbon feed treatment process"], filed by the Applicant on 22 Sep. 2004 with application Ser. No. 04/09997. The contents of this application are hereby incorporated into the present application by reference.

For practical reasons, the adsorbent may be identical to the catalyst used in the hydrocracking zone.

For practical reasons, the adsorbent may be a hydrorefining catalyst or a regenerated hydrocracking catalyst.

Characteristics of Adsorption Process

A variety of designs may be used for the adsorption zone: it may be constituted by one or more fixed beds of adsorbents positioned in series or in parallel.

The choice of two beds in parallel is, however, the most Judicious, as it allows continuous operation. When the first bed is saturated, the second is swung into line to continue adsorption while simultaneously regenerating or replacing the first bed.

It is also possible to cause said zone to function in a batchwise manner, i.e. not to start it up until the concentration of PNA exceeds the fixed critical concentration. This can minimize the volumes of feeds treated, and thus minimize the operational costs.

For good efficiency of the adsorption zone, the operating conditions are generally a temperature in the range 50° C. to 250° C., preferably in the range 100° C. to 150° C., a pressure the range 1 to 200 bars (in one preferred implementation, the pressure is in the range 1 to 10 bars and in another preferred implementation, the pressure is in the range 30 to 200 bars) and a HSV in the range 0.01 to 500 $h^{-1}$, preferably in the range 0.1 to 300 $h^{-1}$, limits included.

The choice of temperature and pressure is made to ensure proper flow of the feed (this must be liquid and the viscosity must not be too high) and good diffusion of PNAs into the pores of the adsorbent while optimizing the adsorption.

The amounts of polyaromatic compounds in the feed to be recycled are generally in the range 0 to 500 ppm for coronene, 0 to 5000 ppm for perylene and for pyrene. At the outlet from the adsorption zone, the contents generally become 40, 1000, 1500 ppm respectively. The molecules are assayed by liquid phase chromatography combined with detection by UV absorption.

Step 4: Regeneration of Adsorbent in the Adsorption Zone by Burning

This step is aimed at eliminating PNAs already absorbed onto the solid of the adsorption zone (step 3) to render it re-usable for a new adsorption step. Burn regeneration of the adsorbent is carried out in a stream of gas based on $N_2$ containing 0.1% to 21% of $O_2$, preferably 3% to 6%, at a temperature in the range 400° C. to 650° C., preferably in the range 500° C. to 550° C. This operation may be carried out ex situ or in situ.

Preferably:

hot stripping is initially carried out with an inert gas such as nitrogen at a temperature of the order of 200-300° C. This may be carried out in co-current mode as well as in counter-current mode. The aim is to eliminate the hydrocarbons trapped in the pores of the grains and beds of the adsorbent and any traces of hydrogen;

burning in the presence of air added to nitrogen in a proportion of the order of 5%; said mixture is sent as a co-current or counter-current to the adsorbent. This operation is initially carried out at a temperature of the order of 400° C. to eliminate hydrocarbons which may be present in the pores of the adsorbent (exothermic reaction);

this operation is repeated at about 450° C. to ensure that all traces of hydrocarbons have disappeared;

when the system once more becomes athermal, the temperature is raised to a temperature in the range 500° C. to 550° C. and it is maintained for about 12 hours to burn the PNAs adsorbed on the surface of the porous solid.

The mesoporous silica-alumina may undergo these treatments about twenty times before having to renew it.

DESCRIPTION OF FIG. 1

The invention is described in a non limiting manner as shown in FIG. 1 in its once-through implementation with a recycle to the inlet to the first reactor. The feed constituted by saturated compounds, resins and aromatic molecules (mono-, di-, tri-aromatics and PNA) arrive via a line (1) and a stream of hydrogen supplied via a line (2) are mixed and introduced into the hydrocarbon reactor (4) via a line (3). The feed at the outlet from the hydrocracker is led via a line (5) to a high pressure distiller (6) which acts to separate gaseous and liquid products. The gas corresponds to hydrogen which has not reacted and is re-injected to the inlet to the hydrocracking reactor via lines (8) and (3). The liquid products are routed via a line (7) to a fractionation zone (9) where, because e of the differences in boiling points, the cracked products (lighter compounds) are separated, which are thus recovered from the top of the column via a line (10), from those which have not been transformed (380+ residues). These latter constitute the bottom of the column and leave via a line (11). A portion of this fraction is optionally eliminated via a line (12). The other portion is sent to a recycle loop via a line (13). Next, depending on the criticality parameters for the concentration of fixed PNA, all or a portion of the feed is sent to an adsorption zone (17) or (18) via lines (14) and (15) or (16). At the outlet from this zone, an effluent with a low or zero PNA concentration is recovered via lines (19) or (20) and (21). It is then sent to a line (22) which is that transporting the portion of the feed not treated by adsorption. The mixture of these two fractions is transported via a line (23) to the line containing the fresh feed, i.e. line (1).

EXAMPLES

Example 1

Preparation of Silica Alumina SA1

Adsorbent SA1 was obtained as follows.

The adsorbent SA1 was an alumina-silica which had a chemical composition of 60% $Al_2O_3$ and 40% $SiO_2$ by weight. Its Si/Al ratio was 0.6. Its sodium content was of the order of 100-120 ppm by weight. The extrudates were cylindrical with a diameter of 1.6 mm. Its specific surface area was 345 $m^2/g$. Its total pore volume, measured by mercury porosimetry, was 0.83 $cm^3/g$. The pore distribution was bimodal. In the mesopores region, a broad peak was observed between 4 and 15 nm with a maximum at 7 nm. For the support, the macropores, with a largest diameter of more than 50 nm, represented about 40% of the total pore volume.

Example 2

Comparison of Elimination of PNAs from a Feed by Adsorption on Porous Solid

The feed used corresponded to residues from the bottom of a fractionation column. Its pour point was of the order of 36° C. and its density at 15° C. was 0.8357. It contained 95% by weight of saturated compounds (83.6% by weight of paraffinic compounds and 11.4% by weight of naphthenic compounds), 0.5% by weight of resins and 2.9% by weight of aromatic compounds, 2.6% by weight of which was constituted by monoaromatic compounds, 0.56% by weight of which was constituted by diaromatic compounds, 0.57% by weight of which was constituted by triaromatic compounds, 2704 ppm of pyrene (4 rings), 1215 ppm of perylene (5 rings) and 59 ppm of coronene (7 rings).

The porous solids tested corresponded to a mesoporous solid of the purely silicic MCM-41 type, a $SiO_2$ bridged beidellite type clay, a silica gel, an activated alumina, a physically activated charcoal from a cellulose precursor and a silica-alumina of the invention. They were selected for their large specific surface area and their large 20 to 80 Å diameter pores depending on the case (Table 1), combined with their ability to be regenerated by burning.

TABLE 1

BET specific surface area and mean pore diameters of different solids

| | Mesoporous | Bridged clay | Silica gel | Activated alumina | Activated charcoal | Silica alumina 1 (SA1) |
|---|---|---|---|---|---|---|
| $S_{BET}$ ($m^2/g$) | 360 | 403 | 550 | 352 | 1442 | 345 |
| $\Phi_{pores}$ (Å) | 56 | 26.5 | 20 | 50 | 25 | 75 + macropores |

The feed was brought into contact with the various adsorbents in a fixed bed with a HSV of 30 at a temperature of 150° C. and at a pressure of 10 bars.

For each of them, the adsorption selectivities for coronene were calculated with respect to perylene and pyrene. The selectivity of an adsorbent for two molecules i and j is defined as follows:

$$\alpha_{i/j} = \frac{q_{ads,i} / C_i}{q_{ads,j} / C_j}$$

When it is greater than 1, this means that the adsorbent adsorbs more of compound i than compound j. In our case, since the coronene selectivities were calculated with respect to lighter PNAs, these values must be more than 1 as the principal aim is to preferentially eliminate the heaviest molecules. The volumes of feed per maximum volume of adsorbent which could be treated so that the concentration of coronene in the feed at the outlet does not exceed ⅔ of that at the inlet were also determined. This ratio allowed the adsorption capacity of the solids to be estimated. These results are shown in Table 2.

TABLE 2

Selectivities and volume of feed which can be treated per volume of adsorbent for the different solids

| | Mesoporous | Bridged clay | Silica gel | Activated alumina | Activated charcoal | Silica alumina 1 (SA1) |
|---|---|---|---|---|---|---|
| $\alpha_{coronene/}$ perylene | 5.5 | 3.1 | 1.4 | 1.5 | 4.8 | 5.5 |
| $\alpha_{coronene/}$ pyrene | 6.2 | 6 | 2.1 | 2.0 | 7.6 | 7.3 |
| $V_{feed}/V_{adsorbent}$ (ml/ml) | 4 | 8 | 6.5 | 12 | 38 | 20 |

It should be noted that the best performances were, as expected, those of activated charcoal. However, the solid which is claimed in the context of this patent also has good selectivities and adsorption capacities. Thus, since it can be regenerated several times in succession by burning, its use is more economic than that of activated charcoal.

Example 3

Regeneration of Adsorbent by Burning

The adsorbent was regenerated by burning using a stream of $N_2$ containing 5% of $O_2$ at 550° C. After these operations, 97% of the capacity of the starting solid was recovered.

This operation could be carried out about ten times before losing 30% of capacity.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 0502368, filed Mar. 9, 2005 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. An improved hydrocracking process with a recycle, comprising eliminating polyaromatic compounds from at least a portion of the recycle by adsorbing said polyaromatic compounds on an adsorbant comprising alumina and silica with a mass content of silica ($SiO_2$) of more than 5% by weight to 95%, said adsorbant having:

a sodium content of less than 0.03% by weight;

a total pore volume, measured by mercury porosimetry, in the range 0.45 to 1.2 ml/g;

a porosity such that:

i) the volume of mesopores with a diameter in the range 40 Å to 150 Å and a mean pore diameter in the range 80 Å to 140 Å represents 30-80% of the total pore volume measured by mercury porosimetry;

ii) the volume of macropores with a diameter of more than 500 Å represents 20-80% of the total pore volume measured by mercury porosimetry;

a BET specific surface area in the range 200 to 550 $m^2/g$; and an X ray diffraction diagram which contains at least the principal characteristic peaks of at least one of the transition aluminas included in the group composed of alpha, rho, khi, eta, gamma, kappa, theta and delta aluminas.

2. A process according to claim 1, which comprises in succession:

a hydrocracking step;

a separation step, to separate an unconverted fraction with a T05 cut point of more than 340° C.; and a step for liquid phase adsorption of all or part of the PNAs contained in said unconverted fraction from the separation step.

3. A process according to claim 2, in which the hydrocracking step is carried out using a once-through mode.

4. A process according to claim 2, in which the hydrocracking step is carried out using a two-step mode.

5. An improved hydrocracking process with a recycle, comprising eliminating polyaromatic compounds from at least a portion of the recycle by adsorbing said polyaromatic compounds on an adsorbant comprising alumina and silica with a mass content of silica ($SiO_2$) of more than 5% by weight to 95%, said adsorbant having:

a sodium content of less than 0.03% by weight;

a total pore volume, measured by mercury porosimetry, in the range 0.45 to 1.2 ml/g;

a porosity such that:

iii) the volume of mesopores with a diameter in the range 40 Å to 150 Å and a mean pore diameter in the range 80 Å to 140 Å represents 30-80% of the total pore volume measured by mercury porosimetry;

iv) the volume of macropores with a diameter of more than 500 Å represents 20-80% of the total pore volume measured by mercury porosimetry;

a BET specific surface area in the range 200 to 550 $m^2/g$; and an X ray diffraction diagram which contains at least the principal characteristic peaks of at least one of the transition aluminas included in the group composed of alpha, rho, khi, eta, gamma, kappa, theta and delta aluminas and wherein the adsorbant undergoes a burning regeneration treatment after the adsorption step.

6. An improved hydrocracking process with a recycle, comprising eliminating polyaromatic compounds from at least a portion of the recycle by adsorbing said polyaromatic compounds on an adsorbant comprising alumina and silica with a mass content of silica ($SiO_2$) of more than 5% by weight to 95%, said adsorbant having:

a sodium content of less than 0.03% by weight;

a total pore volume, measured by mercury porosimetry, in the range 0.45 to 1.2 ml/g;

a porosity such that:

v) the volume of mesopores with a diameter in the range 40 Å to 150 Å and a mean pore diameter in the range 80 Å to 140 Å represents 30-80% of the total pore volume measured by mercury porosimetry;

vi) the volume of macropores with a diameter of more than 500 Å represents 20-80% of the total pore volume measured by mercury porosimetry;

a BET specific surface area in the range 200 to 550 $m^2/g$; and an X ray diffraction diagram which contains at least the principal characteristic peaks of at least one of the transition aluminas included in the group composed of alpha, rho, khi, eta, gamma, kappa, theta and delta aluminas, and wherein the adsorbant undergoes a burning regeneration treatment, which treatment comprises:

hot stripping with an inert gas such as nitrogen at a temperature in the range 200-300° C.;

burning in the presence of air added to nitrogen in a proportion of the order of 5%, at a temperature of the order of 400° C.;

burning in the presence of air added to nitrogen in a proportion of the order of 5%, at a temperature of the order of 450° C.; and raising then maintaining the temperature to a level in the range 500° C. to 550° C. for about 12 hours.

7. A process according to claim 1, in which adsorption is carried out continuously.

8. A process according to claim 1, in which adsorption is carried out batchwise.

9. A process according to claim 1, in which the adsorption step is carried out on the whole of the recycled fraction.

10. An improved hydrocracking process with a recycle, comprising eliminating polyaromatic compounds from at least a portion of the recycle by adsorbing said polyaromatic compounds on an adsorbant comprising alumina and silica with a mass content of silica ($SiO_2$) of more than 5% by weight to 95%, said adsorbant having:

a sodium content of less than 0.03% by weight;

a total pore volume, measured by mercury porosimetry, in the range 0.45 to 1.2 ml/g;

a porosity such that:

vii) the volume of mesopores with a diameter in the range 40 Å to 150 Å and a mean pore diameter in the range 80 Å to 140 Å represents 30-80% of the total pore volume measured by mercury porosimetry;

viii) the volume of macropores with a diameter of more than 500 Å represents 20-80% of the total pore volume measured by mercury porosimetry;

a BET specific surface area in the range 200 to 550 $m^2/g$; and an X ray diffraction diagram which contains at least the principal characteristic peaks of at least one of the transition aluminas included in the group composed of alpha, rho, khi, eta, gamma, kappa, theta and delta aluminas, and wherein adsorption is carried out at a temperature in the range 50° C. to 250° C., a pressure in the range 1 to 200 bars and a HSV in the range 0.01 to 500 $h^{-1}$.

11. A process according to claim 1, in which the adsorbant comprises a proportion of octahedral $Al_{VI}$ determined by solid $^{27}Al$ MAS NMR spectral analysis, of more than 50%.

12. A process according to claim 1, in which the alumina-silica comprises 30% to 50% of $Q^2$ sites in which one Si atom is bonded to two Si or Al atoms and to two OH groups and also comprises 10-30% of $Q^3$ in which one atom of Si is bonded to three atoms of Si or Al or to an OH group.

13. A process according to claim 1, in which the adsorbant is constituted by alumina-silica.

14. A process according to claim 1, in which the adsorbant comprises 1% to 40% by weight of binder.

15. A process according to claim 14, in which the adsorbant results from mixing alumina-silica and at least one binder selected from the group formed by silica, alumina, clays, titanium oxide, boron oxide and zirconia.

16. A process according to claim 1, in which the adsorbant comprises a cationic impurities content of less than 0.1% by weight.

17. A process according to claim 1, in which the adsorbant comprises an anionic impurities content of less than 1% by weight.

18. A process according to claim 1, in which the adsorbant undergoes a hydrothermal treatment before use.

19. A process according to claim 1, in which the adsorbant undergoes a sulphurization treatment before use.

20. A process according to claim 1, in which the adsorbant is identical to the hydrocracking catalyst.

* * * * *